United States Patent [19]

Bair et al.

[11] Patent Number: 4,466,935

[45] Date of Patent: Aug. 21, 1984

[54] ARAMID SPINNING PROCESS

[75] Inventors: Thomas I. Bair, Wilmington, Del.; Leslie W. Gulrich, Jr., Richmond, Va.

[73] Assignee: E. I. Du Pont de Nemours and Company, Wilmington, Del.

[21] Appl. No.: 487,605

[22] Filed: Apr. 22, 1983

[51] Int. Cl.[3] ..... D01F 6/00

[52] U.S. Cl. ..... 264/184; 264/210

[58] Field of Search ..... 264/184, 210.8

[56] References Cited

U.S. PATENT DOCUMENTS 4,075,269 2/1978 Jones et al. ..... 264/184

4,078,034 3/1978 Lewis ..... 264/184

*Primary Examiner*—Jay H. Woo

[57] ABSTRACT

In a dry-spinneret wet-spinning process for the preparation of para-aramid filaments by spinning from sulfuric acid solution, filament tenacity and modulus are increased when the tension is applied to the freshly spun, wet filaments when they contain less than 50% sulfuric acid.

5 Claims, No Drawings

ARAMID SPINNING PROCESS

DESCRIPTION

1. Technical Field

This invention relates to an improved dry-jet wet-spinning process for aromatic polyamides having chain-extending bonds which are coaxial or parallel and oppositely directed whereby tension is applied to partially extracted, freshly spun filaments to provide filaments having improved tenacity and modulus. Aromatic polyamides having chain-extending bonds which are either coaxial or parallel and oppositely directed are hereinafter referred to as para-aramids.

2. Background Art

U.S. Pat. No. 3,767,756 describes a process for spinning para-aramids to provide filaments having excellent as-spun tenacity, modulus and breaking elongation. In practice, sulfuric acid having a concentration of at least 98% is used as the spinning solvent. Due to the degrading effects of even small amounts of sulfuric acid in the yarn, complete removal of the acid is very important in obtaining high tenacity fibers. If water or water containing only minor amounts of sulfuric acid is used as the quench liquid, the filaments leaving the quench bath or quench tube will contain less than 100% sulfuric acid, usually less than 50% sulfuric acid. Subsequently, water alone or combinations of alkaline solutions and water have been used for removal of the remaining sulfuric acid. Remaining liquid is then stripped from the filaments and the filaments are dried on heated rolls and wound up.

U.S. Pat. No. 3,227,793 discloses a wet-spinning process whereby sulfuric acid solutions of poly(polymethylene terephthalamides) are spun into aqueous coagulation baths containing 44 to 50% sulfuric acid. Although the examples and the claims are directed to poly(-polymethylene terephthalamides), poly(p-phenylene terephthalamide) is mentioned among numerous other polymers as being useful in the invention. Because of the depth of the coagulation bath, drawing can take place between a guide placed near the bottom of the coagulation bath and a feed roll.

U.S. Pat. No. 4,340,559 discloses an improved dry-spinneret wet-spinning process for para-aramids. This patent teaches that best filament strength is obtained when the tension on the spinning threadline is as low as possible.

Japanese Patent Publication No. 77/12325 discloses a process whereby aromatic polyamide having chain-extending bonds which are coaxial or parallel and oppositely directed are spun as anisotropic solutions from acid solvents, e.g., sulfuric acid having a concentration of at least 98% through a noncoagulating layer into a coagulating liquid whereby the sulfuric acid content of the resulting filaments is maintained at at least 100% by weight, the filaments are removed from the bath and drawn a specified amount, the filaments are washed to reduce the sulfuric acid content of the filaments to less than 1% and the wet filaments are simultaneously dried and heat treated at a temperature of at least 300° C.

BRIEF DESCRIPTION OF THE INVENTION

This invention provides a process for spinning high strength, high modulus aromatic polyamide filaments from aromatic polyamides having an inherent viscosity of at least 4.0 whose chain-extending bonds are coaxial or parallel and oppositely directed by extruding downwardly an anisotropic solution and having a polyamide concentration of at least 30 g/100 ml 98.0–100.2% sulfuric acid through a layer of noncoagulating fluid into a coagulating liquid whereby coagulating liquid passes downwardly through a spin tube along with the filaments, the filaments are separated from the coagulating liquid and are mechanically forwarded at 200 to 1000 yards per minute (ypm) to one or more washing and/or neutralization stages, wherein the sulfuric acid content is reduced to no more than 50% by weight and a tension in grams per denier of at least $1.9\times10^{-3}$ (ypm)$-2.5\times10^{-4}$(yarn denier) but no less than 0.4 gpd is applied to the filaments between the exit of the spin tube and the washing and/or neutralization stages. Preferably the aromatic polyamide is poly(p-phenylene terephthalamide). It is preferred that the tension on the filaments is applied between the point where the filaments are separated from the coagulating liquid and the washing and/or neutralization stages. Preferably the tension is applied by means of two or more snubbing pins. Alternatively the tension may be applied between two sets of forwarding rolls.

DETAILED DESCRIPTION OF THE INVENTION

The process of the present invention is effective in increasing the tenacity and modulus of all para-aramid filaments but is most effective in the denier range of 60 to 1500 or higher. In the case of higher denier yarns, e.g., 1200, the filaments should be dried under a tension of at least 0.3 gpd in order to preserve the improved tenacity and modulus.

In some cases, highest tenacity and modulus are obtained if additional tension is also applied during washing, neutralization and drying of the filaments. In such instances the tension in washing and neutralization should be in the range of 1.5 to 2.5 gpd and the additional drying tension should be in the range of 2 to 6 gpd.

The tension on the filaments may be applied by two parallel ceramic pins mounted on a rotatable plate. The filaments are passed between the two pins and the plate is rotated to deflect the filaments from their original path thus providing tension between this point and the next filament forwarding device. Alternatively the filaments can be passed alongside of two parallel ceramic pins and a third parallel ceramic pin moved between the first two pins to deflect the filaments from their original path thus applying tension on the filaments between this point and the next filament forwarding device.

Filament tension may be applied between two sets of filament forwarding rolls operating at different speeds.

For convenience, when tension is applied to the filaments using snubbing pins, such pins are best placed approximately half way between the point where the filaments are separated from the coagulating liquid and the next filament forwarding device or approximately half way between the exit of the spin tube and the above mentioned point. The filaments may be separated from the coagulating liquid by a change of direction pin or guide which directs the filaments away from the coagulating liquid. More than one set of snubbing pins may be used if desired. Alternatively the tension may be applied at or near the point where the filaments are separated from the coagulating liquid.

When the coagulating liquid is water or water containing a small amount of sulfuric acid, e.g., about 4%, spin tubes of the type shown in FIG. 1 of U.S. Pat. No. 4,340,559 will extract most of the sulfuric acid from the spinning threadline when the spin tube is about 12 inches long. The following values for sulfuric acid content were found for a 12 inch spin tube.

| Distance in inches from tube exit | % H2SO4* Approx. 60 denier 200 ypm | Approx. 60 denier 400 ypm | 1500 denier 400 ypm |
|---|---|---|---|
| 4 | 11.8 | 19.4 | — |
| 12 | 9.9 | 26.8 | 28.9 |
| 38 | 7.1 | 25.3 | 19.1 |
| 47 | 9.7 | 13.9 | 19.0 |
| 68 | 9.2 | 17.7 | 17.7 |

*dried yarn basis

DEFINITIONS AND TESTS

Linear Density: Linear density is the weight in grams of a specified length of yarn (or filament). When the specified length is 9,000 m, linear density is called "denier". Units when the specified length is 10,000 m are "dtex." Multiplication by 10/9 converts denier to dtex. Measurement usually involves a much shorter length, about 90 cm herein. The exact length is measured with the yarn under 0.1 g/denier (0.09 g/dtex) tension. The weight of this exact length is measured also and then scaled to a length of 9,000 or 10,000 m to determine denier or dtex.

Tensile Properties: Each yarn to be tested is conditioned at least 12 hours in a conditioning environment and then tested in the same environment. The conditioning environment is at 24° C. and 55% R.H. Before testing, each yarn is twisted to a 1.1 twist multiplier (TM) where $$TM = tpi(\text{denier})^{\frac{1}{2}}/73$$

$$TM = tpc(\text{dtex})^{\frac{1}{2}}/30.3$$

and tpi denotes "turns per inch" and tpc denotes "turns per centimeter."

A laboratory stress-strain tester is used for the tests. In the examples, tensile properties are automatically computed by a digital computer fed with the digitized load-elongation curve. Sample length between clamps is initially 10 inches (25.4 cm), and strain rate is 50% per minute. Tenacity, T, (in g/denier or dN/tex) is calculated from the breaking load in grams and from the appropriate linear density. Initial modulus, Mi, (same units as tenacity) is computed from the slope of the first 0.5 inch (1.27 cm) straight section of the load-elongation curve (computer sampling rate is 30 points per second). Elongation, E, is the increase in length at the breaking point divided by the original length and multiplied by 100 for expression as a percentage.

Inherent viscosity: Inherent viscosity (IV) is defined by $$I.V. = ln(\eta_{rel})/c$$

where c is concentration (0.5 g of polymer or fiber in 100 ml of solvent) of the polymer solution and $\eta_{rel}$ (relative viscosity) is the ratio of flow times of polymer solution and solvent at 30° C. in a capillary viscometer. The solvent is concentrated sulfuric acid (95–98% by weight $H_2SO_4$).

EXAMPLE 1

This example illustrates the use of snubbing pins to generate high treadline tension prior to wash/neutralization rolls in an air-gap spinning process. Additionally, it shows the beneficial increase in yarn modulus and tenacity as a result of snubbing the threadline.

PPD-T polymer of 5.6 I.V. is added over a period of several minutes to frozen sulfuric acid snow (100.05% $H_2SO_4$) at −10° to −15° C. through a top entrance of fluid jacketed "Atlantic Mixer" equipped with an exit gear pump. The ratio of the mixture is 19.7 gms polymer to 80.3 gms $H_2SO_4$. The mixture is sealed and the mixing blades started. The temperature of the fluid jacket is increased to about 71° C. over a period of about 1½ hr. The temperature is then brought to 80° C. and mixing continued for about ½ hr. Mixing is then stopped and the dope degassed under vacuum for about 1½ hr. The hot dope is pumped from the mixer through a transfer line closely wrapped with a hot water line (80°–90° C.) to an electrically heated (80° C.) spinning block and attached gear pump. The gear pump meters the dope through another passage in the block to an electrically heated (75°–80° C.) spinneret pack containing a backing screen, distributing screen, filtering medium and a 1.0 inch diameter spinneret containing 40 holes of 2.5 mil diameter. The dope is extruded from the spinneret downwardly through a 3/16 inch gap of air into a constantly replenished cold (0°–5° C.) water bath having an attached vertical spin tube (¾ inches I.D. with an entry constriction of ¼ inches I.D.; 12 inches length) which extends into the bath to 1¼ inches from the water surface. The coagulated extrudate passes through the 1¼ inch of water and then enters the spin tube along with a portion of the cold bath water. The quenched threadline containing <50% acid is then directed over two polished ceramic pins (3/16 inch diameter; spaced on ⅝ inch centers) placed immediately below and in-line with the spin tube exit. The angle ("snub angle") the threadline passing between the pins makes with its projected path in the absence of the pins is varied by the relative position of the two ceramic pins. The yarn then passes under a ceramic rod about 25 inches from the spin tube to direct the threadline to three successive sets of wash/neutralization rolls. Threadline tension is measured between this rod and the first set of rolls using a hand-held tensiometer. The yarn then travels 30 inches from the ceramic rod to the first set of wash rolls on which the yarn is sprayed with water to remove nearly all surfuric acid. On the second set of rolls, the yarn is sprayed with dilute (0.5%) NaOH to neutralize any residual $H_2SO_4$. Finally, on the third set of rolls the yarn is sprayed again with water to remove salts. The purified yarn is wound up and dried on the bobbin at room temperature. The yarns have excellent mechanical quality (i.e., no broken filaments).

Yarns were spun in which the snub angle was between 90° and 160°. Spinning speed was 200, 400, and 700 ypm and extrusion rates were varied to maintain a nominal 1.5 dpf yarn. Tensions on the threadline varied from 0.7 to 5.5 gpd. The higher values were obtained for higher snub angles and higher spinning speeds. Control yarns were spun exactly the same way except that no snub pins were employed. A second set of samples were spun in which an additional snubbing device was placed about 35 inches from the exit of the spin tube but before the wash rolls. Results from both sets of yarns are tabulated in Table 1.

TABLE 1

| YARN NO. | SPEED, ypm | SNUB ANGLE * | SNUB ANGLE ** | TEN-SION (gpd) | T, gpd | M, gpd | ΔT, gpd | ΔM, gpd |
|---|---|---|---|---|---|---|---|---|
| 1 | 200 | — | — | | 24.7 | 673 | — | — |
| 2 | 400 | — | — | | 24.8 | 707 | — | — |
| 3 | 700 | — | — | | 21.7 | 692 | — | — |
| 4 | 200 | 90 | — | 0.7 | 26.2 | 759 | 1.5 | 86 |
| 5 | 200 | 135 | — | 0.9 | 26.4 | 800 | 1.7 | 127 |
| 6 | 200 | 160 | — | 1.5 | 26.9 | 813 | 2.2 | 140 |
| 7 | 400 | 90 | — | 1.6 | 25.2 | 800 | 0.4 | 93 |
| 8 | 400 | 135 | — | 2.3 | 25.9 | 860 | 1.1 | 153 |
| 9 | 400 | 160 | — | 3.0 | 25.3 | 848 | 0.5 | 141 |
| 10 | 700 | 90 | — | 2.6 | 22.2 | 765 | 0.5 | 73 |
| 11 | 700 | 135 | — | 5.5 | 22.9 | 848 | 1.2 | 156 |
| 12 | 200 | 90 | 135 | 2.9 | 26.5 | 868 | 1.8 | 185 |
| 13 | 200 | 90 | 100 | 1.8 | 25.5 | 821 | 0.8 | 148 |
| 14 | 200 | 135 | 135 | 3.5 | 27.1 | 905 | 2.4 | 232 |
| 15 | 200 | 135 | 100 | 2.2 | 27.0 | 839 | 2.3 | 166 |
| 16 | 200 | 160 | 135 | 5.1 | 27.3 | 949 | 2.6 | 276 |
| 17 | 200 | 160 | 100 | 3.4 | 28.3 | 906 | 3.6 | 233 |
| 18 | 400 | 90 | 135 | 4.7 | 25.8 | 913 | 1.0 | 206 |
| 19 | 400 | 90 | 100 | 3.3 | 25.8 | 911 | 1.0 | 204 |
| 20 | 400 | 135 | 135 | 5.9 | 25.6 | 962 | 0.8 | 255 |
| 21 | 400 | 135 | 90 | 4.1 | 24.5 | 918 | (0.3) | 211 |
| 22 | 400 | 160 | 135 | 7.9 | 25.7 | 963 | 0.9 | 256 |
| 23 | 400 | 160 | 100 | 4.9 | 25.9 | 893 | 1.1 | 186 |
| 24 | 700 | 90 | 75 | 6.9 | 23.2 | 939 | 1.5 | 247 |

*First Device Degrees
**Second Device Degrees

EXAMPLE 2

This example further demonstrates the use of snubbing pins placed about 35 inches past the spin tube to generate high threadline tension and improved fiber tenacity and modulus while maintaining excellent yarn mechanical quality.

The procedure of Example 1 was followed to prepare a spin dope and yarn except that the dope contained a ratio of 19.5 gms. polymer to 80.5 gms. $H_2SO_4$ and that the snub pins were placed after the change of direction rod and about 35 inches beyond the end of the spin tube. The snub angle was 0° for control yarns spun at 200, 300, 400, 600 and 700 ypm and 135° for improved yarn prepared at the same speeds. Yarn mechanical quality was very good for all items. Threadline tensions and yarn properties are tabulated in Table 2.

TABLE 2

| YARN NO. | SPEED ypm | SNUB ANGLE, degrees | TEN-SION gpd | T, gpd | M, gpd | ΔT, gpd | ΔM, gpd |
|---|---|---|---|---|---|---|---|
| 1 | 200 | — | — | 27.5 | 722 | — | — |
| 2 | 300 | — | — | 25.1 | 754 | — | — |
| 3 | 400 | — | — | 23.9 | 705 | — | — |
| 4 | 600 | — | — | 23.7 | 711 | — | — |
| 5 | 700 | — | — | 22.0 | 755 | — | — |
| 6 | 200 | 135 | 0.7 | 27.2 | 776 | (0.3) | 34 |
| 7 | 300 | 135 | 2.3 | 25.8 | 825 | 0.7 | 71 |
| 8 | 400 | 135 | 1.9 | 25.1 | 855 | 1.2 | 150 |
| 9 | 600 | 135 | 3.1 | 24.2 | 894 | 0.5 | 183 |
| 10 | 700 | 135 | 3.9 | 24.0 | 845 | 2.0 | 90 |

EXAMPLE 3

This example illustrates the use of snub pin tension to improve the tenacity and modulus of high denier yarn prepared by coupled quench-dry.

The procedure of Example 1 was followed to prepare a spin dope except that the dope contained a ratio of 19.9 gms. polymer to 80.1 gms $H_2SO_4$. The hot dope is pumped from the mixer through a transfer line traced with a hot water line (80°–90°) to an electrically heated (80° C.) spinning block and attached metering gear pump. The gear pump meters the dope through another passage in the block to an electrically heated (75°–80°) spinneret pack containing a backing screen, distributing screen, filtering medium and a 1.875 inch (4.762 cm) diameter spinneret containing 1000 holes of 2.5 mil (0.0635 mm) diameter. The dope is extruded from the spinneret downwardly through a 0.1875 inch (0.476 cm) gap of air into a constantly replenished cold (0°–5° C.) water bath having an attached vertical spin tube 1.562 inch (3.102 cm) I.D. with an entry constriction of 0.25 in (0.635 cm) I.D. which extends into the bath to 0.75 inches (1.905 cm) from the water surface. The coagulated extrudate passes through the 0.75 inch (1.905 cm) of water and then enters the spin tube along with a portion of the cold water bath. The quenched threadline containing less than 50% solvent acid is then directed over two parallel polished ceramic pins (0.375 inch (0.952 cm) diameter; spaced on 1 inch (2.5 cm) centers) placed directly below and in-line with the spin tube at a distance of 3 inches from the spin tube. The angle ("snub angle"), the threadline passing between the pins makes with its projected path in the absence of the pins, is varied by the relative position of the two ceramic pins. The yarn then passes under a ceramic rod about 38 inches (0.965 m) from the spin tube which directs the threadline to two successive sets of wash-/neutralization rolls. Threadline tension is measured between this rod and the first set of rolls using a hand-held tensiometer. The yarn then travels about 36 inches (0.914 m) from the ceramic rod to the first set of wash rolls on which the yarn is sprayed with water to remove nearly all sulfuric acid. On the second set of rolls, the yarn is sprayed with dilute (e.g., 0.5% NaOH to neutralize residual $H_2SO_4$. The yarn then passes over a set of heated drying drums at about 155° to dry the wet yarn to less than <20% moisture. The yarn is then wound on a bobbin.

Yarns were spun in which the snub angle was between 45° and 160°. Spinning speed was 400 ypm and extrusion rate of dope was sufficient to maintain a nominal 1.5 dpf yarn. Tension on the threadline varied from 0.5 to 1.0 gpd. A control yarn was spun exactly the same way except that no snub pins were employed.

A second set of samples was spun in which an additional snubbing device was at 12" from the end of the spin tube to allow very high threadline tensions to be attained. Results from both sets of yarn are tabulated in Table 3 and show that snub tension substantially improves yarn tenacity and modulus.

TABLE 3

| YARN NO. | SNUB ANGLE* 3" | SNUB ANGLE* 12" | TEN-SION (gpd) | T** | M** | ΔT** | ΔM** |
|---|---|---|---|---|---|---|---|
| 1 | CONTROL | | — | 18.8 | 636 | — | — |
| 2 | 45 | — | 0.49 | 21.6 | 684 | 2.8 | 48 |
| 3 | 90 | — | 0.64 | 22.4 | 715 | 3.6 | 79 |
| 4 | 135 | — | 0.80 | 22.0 | 734 | 3.2 | 98 |
| 5 | 160 | — | 1.04 | 22.2 | 760 | 3.4 | 124 |
| 6 | 135 | 90 | 1.48 | 21.0 | 681 | 2.2 | 45 |
| 7 | 45 | 135 | 1.69 | 21.8 | 697 | 3.0 | 61 |
| 8 | 90 | 135 | 2.06 | 21.3 | 696 | 2.5 | 60 |
| 9 | 135 | 135 | 2.39 | 22.8 | 741 | 4.0 | 105 |

*degrees
**gpd

EXAMPLE 4

This example illustrates the use of a differently designed set of snubbing pins to generate high tension prior to the feed rolls in an air-gap spinning process as described in Blades U.S. Pat. No. 3,767,756. It also shows the beneficial effect of snubbing on modulus and tenacity for yarns of higher denier.

A dope of PPD-T polymer (5.5–5.9 I.V.) at 19.4 to 19.5% by weight solids dissolved in 100.1% by weight $H_2SO_4$ is spun at 80° C. through a spinneret containing 760 holes of 2.5 mil (0.0635 mm) diameter into an air gap of about 0.188 inch (0.48 cm) and then into a constantly replenished water bath (0°–5° C.) containing a vertical spin tube with its entrance submerged below the surface of the water as described in Example 3. The threadline, after exiting the spin tube, contains less than 50% by weight acid (based on dry weight of yarn) and passes around a ceramic rod to change its direction of advance from vertical to nearly horizontal. Next it passes through a snubbing device about 36 in (0.91 m) beyond the rod and then to the feed rolls positioned about 34 in (0.61 m) beyond the snubbing device.

The snubbing device consists of two stationary ceramic pins about 1.0 in (2–5 cm) in diameter and a similar movable pin which, after stringup, can be moved so that the yarn turns 90° about the first pin, 180° around the second (movable) pin, and a reverse 90° aound the third.

From the feed roll, the yarn passes under "wash roll tension" to a pair of wash rolls where water spraying occurs, then under "neutralization roll tension" to a pair of rolls where any residual acid is neutralized by sprays of dilute caustic; and finally under "dryer inlet tension" to a specified number of wraps about dryer rolls internally heated with steam at a specified temperature. The dried yarns (still containing more than 6% by weight water) are then wound on bobbins.

The table includes specific process conditions and tensile properties of the resultant yarns. The "snub to feed roll tensions" for control yarns are simply the tensions measured with snub pins removed.

TABLE 4

| | Control 1 | 4A | 4B | 4C | 4D | Control 2 |
|---|---|---|---|---|---|---|
| Spin speed (ypm) | 400 | 400 | 400 | 400 | 400 | 400 |
| (mpm) | (366) | (366) | (366) | (366) | (366) | (366) |
| Tensions | | | | | | |
| Snub to feed roll (gpd) | <0.25 | 1.40 | 1.40 | 1.40 | 1.40 | <0.25 |
| (dN/tex) | (<0.22) | (1.24) | (1.24) | (1.24) | (1.24) | (<0.22) |
| Wash roll (gpd) | 0.88 | 0.88 | 1.75 | 0.88 | 1.75 | 1.75 |
| (dN/tex) | (0.78) | (0.78) | (1.55) | (0.78) | (1.55) | (1.55) |
| Neutralization (gpd) | 0.88 | 0.88 | 1.75 | 0.88 | 1.75 | 1.75 |
| (dN/tex) | (0.78) | (0.78) | (1.55) | (0.78) | (1.55) | (1.55) |
| Dryer inlet (gpd) | 0.75 | 0.75 | 0.75 | 5.26 | 3.51 | 5.26 |
| (dN/tex) | (0.66) | (0.66) | (0.66) | (4.65) | (3.10) | (4.65) |
| Dryer Temp. (°C.) | 153 | 153 | 153 | 153 | 153 | 153 |
| Dryer wraps | 17 | 17 | 17 | 26 | 26 | 26 |
| Properties | | | | | | |
| Denier | 1130 | 1141 | 1143 | 1129 | 1143 | 1129 |
| (dtex) | (1256) | (1268) | (1270) | (1254) | (1270) | (1254) |
| Tenacity (gpd) (T) | 24.6 | 27.0 | 26.7 | 27.3 | 27.4 | 27.5 |
| (dN/tex) | (21.7) | (23.9) | (23.6) | (24.1) | (24.2) | (24.3) |
| Elongation (%) (E) | 3.30 | 3.34 | 3.23 | 2.92 | 2.96 | 2.85 |
| Modulus (gpd) | 691 | 733 | 772 | 873 | 880 | 899 |
| (dN/tex) | (611) | (648) | (682) | (772) | (778) | (795) |
| TE/2 (gpd) | 0.41 | 0.45 | 0.43 | 0.40 | 0.41 | 0.39 |
| (dN/tex) | (0.36) | (0.40) | (0.38) | (0.35) | (0.36) | (0.34) |

EXAMPLE 5

Except for the increased spinning speed, this example duplicates the procedure of Example 4. Nominal denier is the same as for Example 4, i.e., 1140 (1267 dtex). Spinning speed is 600 ypm (549 mpm).

TABLE 5

| | Control 3 | 5 |
|---|---|---|
| Tensions | | |
| Snub to feed roll (gpd) | <0.25 | 1.40 |
| (dN/tex) | (<0.22) | (1.24) |
| Wash roll (gpd) | 0.88 | 1.76 |
| (dN/tex) | (0.78) | (1.56) |
| Neutralization (gpd) | 0.88 | 1.76 |
| (dN/tex) | (0.78) | (1.56) |
| Dryer inlet (gpd) | 0.75 | 0.75 |
| (dN/tex) | (0.66) | (0.66) |
| Dryer Temp (°C.) | 156 | 156 |
| Dryer wraps | 17 | 17 |
| Properties | | |
| Tenacity (gpd) (T) | 24.5 | 25.4 |
| (dN/tex) | (21.7) | (22.4) |
| Elongation (%) (E) | 3.5 | 2.9 |
| Modulus (gpd) | 617 | 838 |
| (dN/tex) | (545) | (741) |
| TE/2 (gpd) | 0.43 | 0.37 |
| (dN/tex) | (0.38) | (0.32) |

What is claimed is:

1. A process for spinning high strength, high modulus aromatic polyamide filaments from aromatic polyamides having an inherent viscosity of at least 4.0 whose chain-extending bonds are coaxial or parallel and oppositely directed by extruding downwardly an anisotropic solution having a polyamide concentration of at least 30 g/100 ml 98.0–100.2% sulfuric acid through a layer of noncoagulating fluid into a coagulating liquid whereby coagulating liquid passes downwardly through a spin tube along with the filaments, the filaments are separated from the coagulating liquid and are mechanically forwarded at 200 to 1000 yards per minute (ypm) to one or more washing and/or neutralization stages, wherein the sulfuric acid content is reduced to no more than 50% by weight and a tension in grams per denier of at least $1.9\times10^{-3}$ (ypm) $-2.5\times10^{-4}$ (yarn denier) but no less than 0.4 gpd is applied to filaments between the exit of the spin tube and the washing and/or neutralization stages.

2. Process of claim 1 wherein the aromatic polyamide is poly(p-phenylene terephthalamide).

3. Process of claim 1 wherein the tension is applied between the point where the filaments are separated from the coagulating liquid and the washing and/or neutralization stages.

4. Process of claim 3 wherein the tension on the filaments is applied by means of two or more snubbing pins.

5. Process of claim 3 wherein the tension is applied between two sets of forwarding rolls.

* * * * *